US010441046B2

(12) United States Patent
Davis et al.

(10) Patent No.: US 10,441,046 B2
(45) Date of Patent: Oct. 15, 2019

(54) HAIR CURLING SYSTEM

(71) Applicant: Cali-Curl, LLC, Dallas, TX (US)

(72) Inventors: Steven D. Davis, Dallas, TX (US); Kevin Hoye, Dallas, TX (US)

(73) Assignee: Cali-Curl, LLC, Dallas, TX (US)

( * ) Notice: Subject to any disclaimer, the term of this patent is extended or adjusted under 35 U.S.C. 154(b) by 0 days.

(21) Appl. No.: 16/186,126

(22) Filed: Nov. 9, 2018

(65) Prior Publication Data

US 2019/0142128 A1 May 16, 2019

Related U.S. Application Data

(60) Provisional application No. 62/584,332, filed on Nov. 10, 2017.

(51) Int. Cl.

| | |
|---|---|
| ***A45D 7/04*** | (2006.01) |
| ***A45D 2/00*** | (2006.01) |
| ***A45D 20/00*** | (2006.01) |
| ***A45D 7/06*** | (2006.01) |

(52) U.S. Cl.

CPC ..... *A45D 2/00* (2013.01); *A45D 7/04* (2013.01); *A45D 7/06* (2013.01); *A45D 20/00* (2013.01)

(58) Field of Classification Search

CPC ... A45D 2/00; A45D 2/02; A45D 2/08; A45D 2/12; A45D 2/148; A45D 2/22; A45D 2/36; A45D 2/367; A45D 2/38; A45D 7/02; A45D 7/04; A45D 7/06; A45D 20/00

USPC ..... 132/270, 245

See application file for complete search history.

(56) References Cited

U.S. PATENT DOCUMENTS

| | | | | |
|---|---|---|---|---|
| 2,008,656 | A * | 7/1935 | Hamilton | A45D 2/06 132/242 |
| 2,042,397 | A * | 5/1936 | High | A45D 2/10 132/252 |
| 2,173,872 | A * | 9/1939 | Barnes | A45D 2/10 132/255 |
| 2,769,449 | A * | 11/1956 | Portell | A45D 2/10 132/250 |
| 3,213,860 | A | 10/1965 | Mizell et al. | |
| 3,213,861 | A | 10/1965 | Vitello | |
| 3,213,863 | A | 10/1965 | Underwood | |
| 5,076,299 | A | 12/1991 | Wistrand et al. | |
| 2010/0101595 | A1 * | 4/2010 | Glenn, Jr. | A45D 19/0008 132/208 |

* cited by examiner

*Primary Examiner* — Rachel R Steitz

(57) ABSTRACT

Aspects of hair styling instruments and methods for styling hair into waves and curls have been provided herein. In one embodiment, a case for receiving and styling hair therein, comprises a base having at least a bottom, a center, and a perimeter; and a lid coupleable with the base; wherein the lid and the base form a volume for receiving the hair; and wherein the at least the bottom of the base and the lid each include a plurality of openings to allow flow of air and liquids through the case.

20 Claims, 10 Drawing Sheets

HAIR CURLING SYSTEM

CROSS-REFERENCE TO RELATED APPLICATION

This application claims the benefit of U.S. Provisional Application Ser. No. 62/584,332 filed on Nov. 10, 2017, entitled "HAIR CURLING SYSTEM," incorporated herein by reference.

TECHNICAL FIELD

This application is directed, in general, to a system for styling hair and, more specifically, to a device and method for applying curls and waves to hair.

BACKGROUND

Hair stylists provide many services to their customers including cutting, coloring and styling. Several styles involve curling and waving the hair into various shapes and sizes of curls and waves. One such style is generally called a "beach curl" where hair is styled having loose curls and/or a wavy appearance.

BRIEF DESCRIPTION

Reference is now made to the following descriptions taken in conjunction with the accompanying drawings, in which.

Figure 4A:
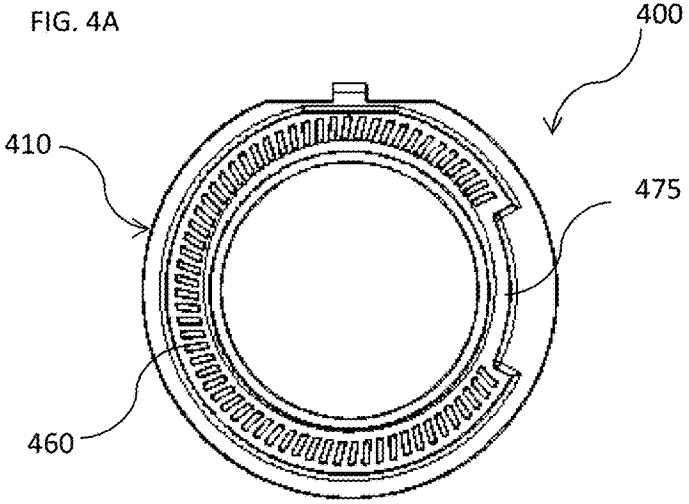
FIGS. 4A and 4B represent another yet embodiment of a case used for curling a person's hair according to principles of the disclosure.
Figure 4B:
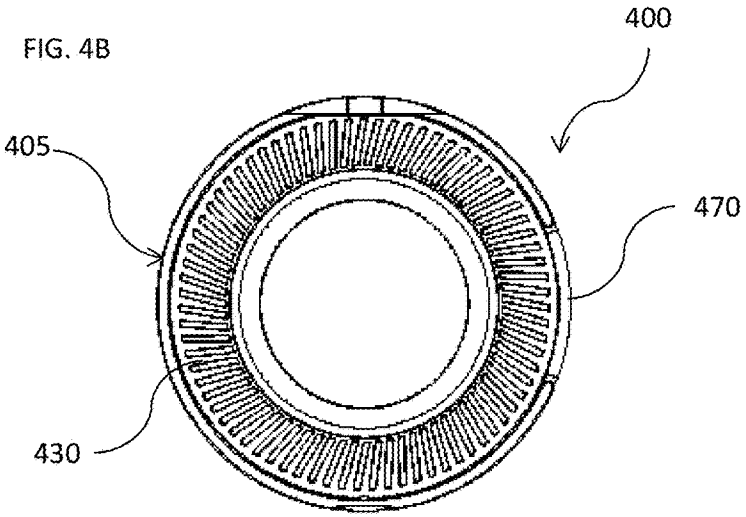
Figure 6:
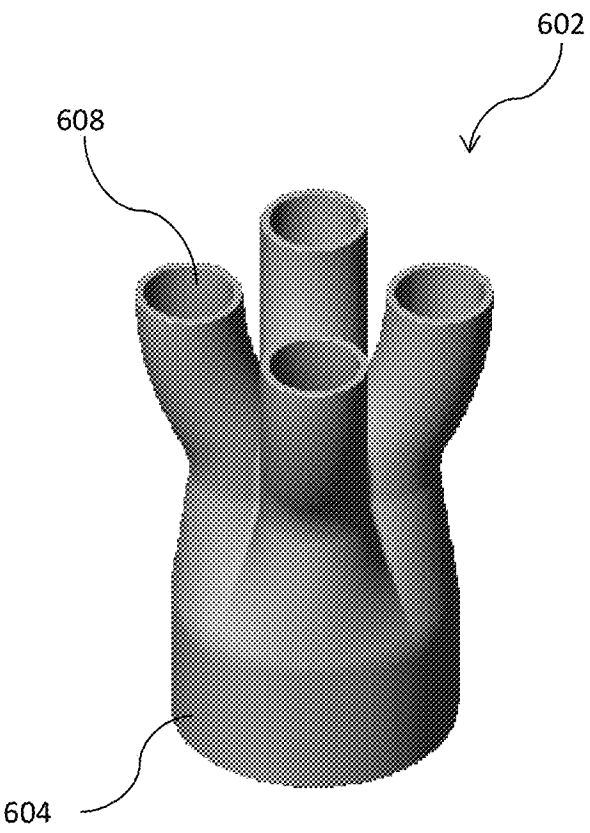
FIG. 6 is another embodiment of an adapter that may be used with a hair dryer to provide heat to a case used for curling a person's hair according to principles of the disclosure.
Figure 5:
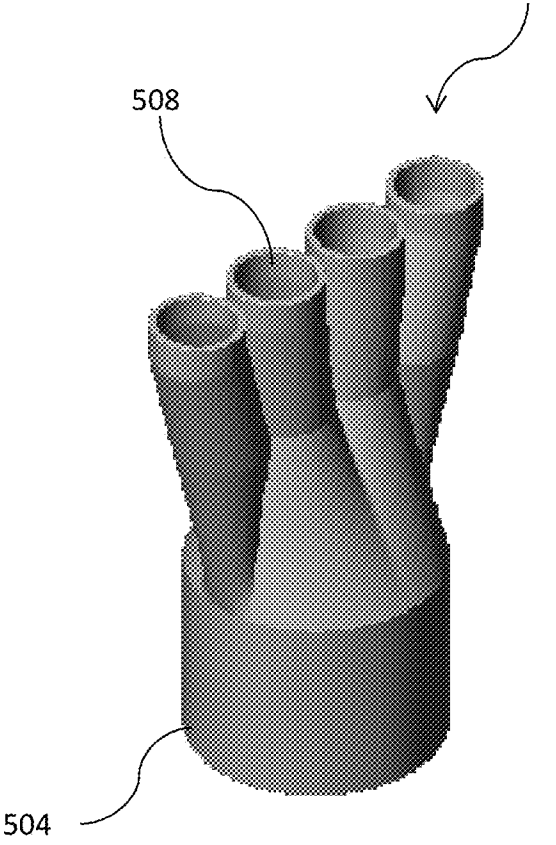
FIG. 5 is one embodiment of an adapter that may be used with a hair dryer to provide heat to a case used for curling a person's hair according to principles of the disclosure.

FIG. 11A through 11E illustrate an embodiment of a coupler which may be used to connect a dryer stand such as shown in FIGS. 9 and 10 or blow dryer adapter FIGS. 5 and 6 with any of the cases shown in FIGS. 1-4 and 8 according to principles of the disclosure; and FIG. 12A through 12E illustrate another embodiment of a coupler which may be used to connect a dryer stand such as shown in FIGS. 9 and 10 or blow dryer adapter FIGS. 5 and 6 with any of the cases shown in FIGS. 1-4 and 8 according to principles of the disclosure.

DETAILED DESCRIPTION

Certain hair styling such as chemically texturizing hair to achieve curls or waves, generally requires wrapping a portion of the hair around a curling device or form, such as a roller or curling rod, and thereafter applying a clip to secure the hair around the form. A chemical solution or reagent may be applied to the wrapped hair and heat may or may not be applied, depending on the type of solution used. The solution is kept on the hair for a defined period of time and once the defined period of time has passed, the solution is rinsed from the hair and the hair is removed from the form.

Traditional curling rods require a clip, band, or strap to keep the hair positioned about the rod. However, the clip or strap may not only create an undesired crease on a client's hair, but may also apply tension to the hair and may result in breakage or other damage to some of the hair.

The present disclosure provides an improved tool and method for applying a "permanent" or "semi-permanent" wave and/or curl to a consumer's hair. In one aspect, a case comprises a base having at least a bottom, a center, and perimeter, and a lid which attaches onto the base. The bottom of the base and the lid may have a plurality of openings formed therein, the openings enabling flow/draining of liquids through the case.

A method for curling and/or waving hair is also disclosed. In one embodiment, at least one case is provided, and in some embodiments, four or more cases may be provided, each case comprising a base having at least a bottom, a center, and perimeter, and a lid which attaches onto the base. The bottom of the base and the lid may have a plurality of openings formed therein. A user, such as a professional hair stylist, divides a person's hair into at least four sections. Each section is then twisted, in some embodiments, like a rope, and then wrapped around the center of the base. The lid is then closed over the base to maintain the hair in place. A styling solution is applied to the hair wrapped within the base. In some embodiments, the styling solution may be a texturizing solution, such as, e.g., a "permanent" or "semi-permanent" chemical solution, and in some embodiments, may be heat activated, wherein a heat source would then be applied to the hair within the case. In other embodiments, the styling solution may include other types of texturizing solutions.

Figure 1B:
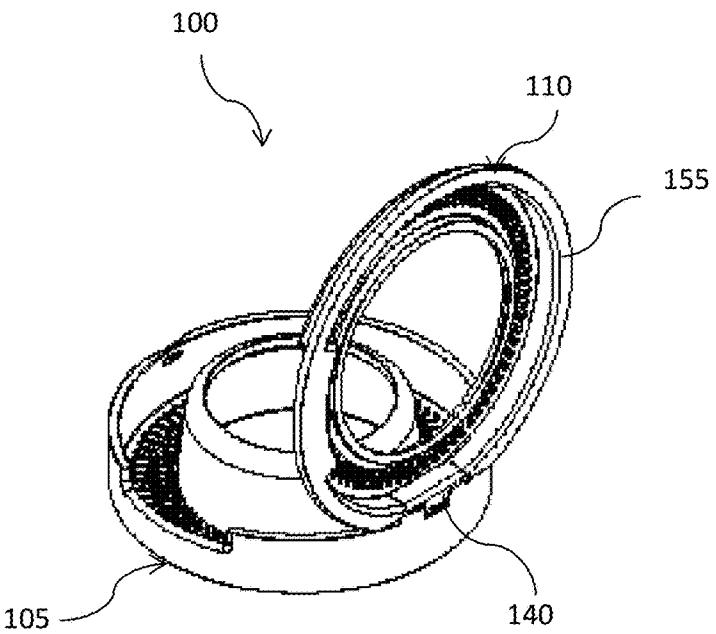
FIG. 1A through 1C represent one embodiment of a case used for curling a person's hair according to principles of the disclosure.
Figure 1A:
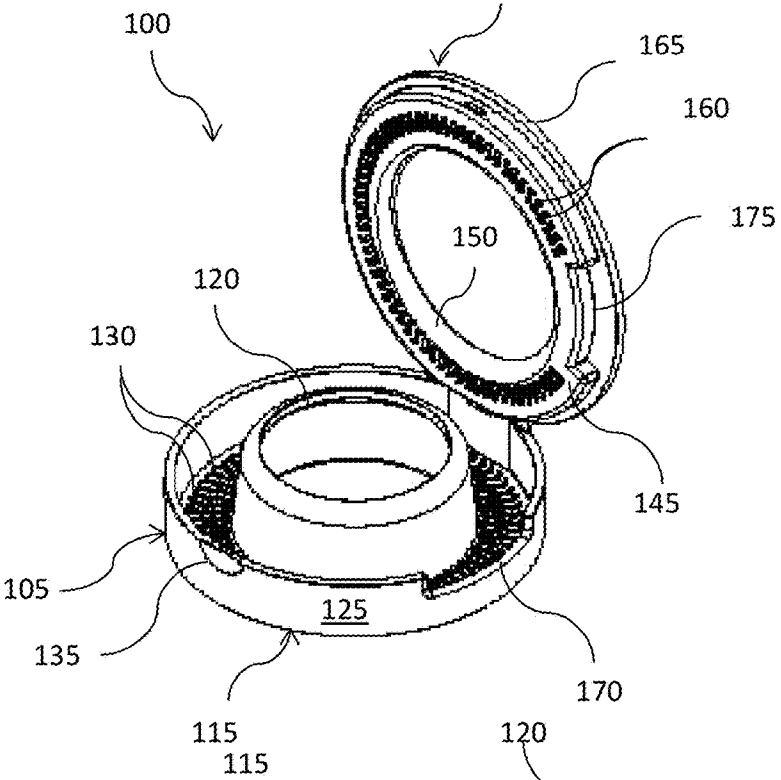
Figure 1C:
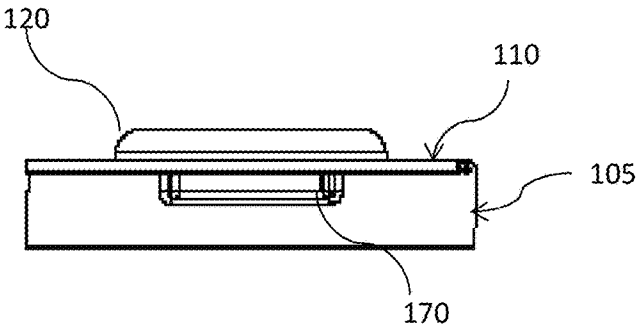

Referring now to FIG. 1A through 1C, there is shown one embodiment of a case 100 which may be used for applying curls to a client's hair according to the principles of the disclosure. The case 100 includes a base 105 and a lid 110. The base 105 includes at least a bottom 115, a center 120, and perimeter 125. The bottom 115 includes a plurality of openings 130 at least between the center 120 and perimeter 125, the openings 130 enabling airflow through the case 100 and as needed, drainage of fluids from within the case 100. In addition to the openings 130 between the center 120 and perimeter 125, some embodiments may also include openings the center 120 and/or the perimeter 125.

In some embodiments, the center 120 may be solid, or may be open in the center thereof. In other embodiments, the center 120 may have a beveled edge as shown in FIG. 1A-1C. In some embodiments, the center 120 may be substantially annular, and in other embodiments, the center 120 have other forms that are substantially symmetrical, such as hexagonal, octagonal, etc. In some embodiments, the bottom 115 may have a plurality of raised nodules which may help hold hair in place once the hair is wrapped around the center. The perimeter 125 may include a notch 135 in one side thereof such that a thumb or finger may be placed for opening the case 100. In some embodiments, rather than the notch, the lid 110 may have a tab or indention in a corresponding location, which when the lid 110 is closed, will be positioned over the notch to enable a user to open the lid 110 with a thumb or finger of the same hand that is holding the case 100.

The lid 110 is coupleable with the base 105, in this embodiment, by a hinge 140, which enables the lid 110 to easily open and close over the base 105. In other embodiments other coupling devices and/or methods known to those skilled in the art such as dowels, pins, molded in hinges on the lid or base, and various other fasteners may be used. In other embodiments, the base 102 and lid 110 may be formed as one piece and the lid 110 is coupled with the base 105 via a "living hinge", similar to, e.g., a hinge used in a toothpaste cap. In still other embodiments, the lid 110 may snap onto the base 105, and in other embodiments, the lid 110 may twist onto the base 105.

In some embodiments, the lid 110 may include an upper portion 145, a center 150, and a perimeter 155. In some embodiments, the upper portion 145 may be indented and configured to mate up with the base 105 of a case 100 stacked thereon, such one or more cases 100 may be stacked on top of each other. The lid 110 may comprise a plurality of openings 160, wherein together with the openings 130 of the base 105, better enable airflow through the case 100 and drainage of fluids from within the case 100 than just the openings 130 in the base 105. The shape of the openings 130 and 160 may be varied, both in shape and quantity, depending on the styling application and user of the case 100. As shown in FIGS. 1A and 1B, the openings 130 and 160 may have an "S-shape" and be dense in number so that the openings 130 and 160 are spaced relatively close together.

The lid 110 and upper portion 145 may be configured having beveled edges and/or a chamfered surfaces, at least where the lid 110 may contact the center 120 of the base 105 to prevent kinks or creases in the hair when the lid 110 is closed down onto the base 105. In some embodiments, the center 150 of lid 110 may be open as shown in FIGS. 1A-1C, and in other embodiments, the center may be a closed, substantially solid surface. Embodiments having additional shapes and spacing will be shown in FIG. 2A through 4B.

FIG. 1C illustrates the case 100 with the lid 110 closed onto the base 105. As shown in FIG. 1C, the center 120 of the base 105 may protrude above the lid 110 when the case 100 is closed. In some embodiments, the base 105 may include a lateral opening 170 or slot in the perimeter, with the lid 110 having a similar lateral indention 175 providing a space for hair extending from the scalp to the hair placed into the case to rest therein. The lateral openings 170 and 175 may have beveled edges on one or more sides. In some embodiments, the lateral opening 170 may have comb teeth therein to engage hair placed therein, or similarly, may have raised bumps or nodules to engage hair therein.

Case 100 may be used by professional stylists to apply curls and waves to a client's hair in a professional salon setting. One example for using one or more cases 100 will be described in more detail in Instructions Set One. Cases 100 may have various heights and diameters, wherein larger sized cases may be used on thick or long hair, and smaller cases may be used on hair that may be shorter and/or thinner in texture.

| INSTRUCTIONS SET ONE<br>EXAMPLE OF PROCESS FOR PROFESSIONAL STYLISTS |
|---|
| Shampoo the hair or prepare the hair for a perm. |
| Brush hair out. |
| Choose the appropriate size case, such as case 100, based on length and volume of hair the procedure is being performed on. |
| Open all four cases 100 and set to the side. |
| Divide hair into four substantially equal quadrants using two parts, ear to ear and front to back. |
| Note: Optionally part the hair where the client parts the hair (E.g. If client parts hair toward the right you may consider moving the part for the four quadrants to match the client's part.) |
| Starting left or right front quadrant put the hair into a tight ponytail shape up against the scalp. |
| Twist hair from the base of the scalp to end of the hair in the direction away from the client's face creating a "Roping" effect. |
| Lift an open case up to the base of the scalp where the roped hair begins. |
| Align the indention 170 of the base 105 with the base of the roped hair. |
| Allow the hair to naturally coil around the raised center 120 of the case and rest in the bottom 115. |
| Once the end of the roped hair is reached, lay the hair evenly and smoothly in the base 105 of case 100. If the hair does not evenly fill the case 100 around the center120, foam spacers may be inserted about all or part of the hair. The foam used may be an open-cell foam which allows moisture and air to penetrate through onto the hair. One the hair and any foam is placed, close the lid 110 ensuring that the hair is not caught in the hinge 140 or coming out of the case 100 anywhere. |
| Repeat these steps with the rear quadrant on the same side roping in the same direction. |
| Move to the other side and repeat these steps for the front quadrant and rear quadrant roping this time roping in the opposite direct (still away from the face). |
| Mix perm solution as directed. |
| Apply perm solution to each case 100 for all 4 quadrants; ensuring hair is soaked thoroughly in solution. |
| Cover each case 100 with a cap such as, e.g., a plastic bouffant cap to contain dripping or one large plastic bouffant cap that covers head and holds all 4 cases 100 within. |
| Wait allotted processing time directed for perm solution. |
| Remove caps. |
| Rinse hair thoroughly with water through all 4 cases with low pressure from nozzle. Low pressure is important not to disrupt how the hair is laying within the case. |
| If foam was placed over the air, remove the foam, and place aside so it can be placed on the hair after the following step. |
| Using towels and/or paper towels lightly towel blot the hair dry either through the case or by carefully opening the case and lightly towel blotting directly. Alternatively, an absorbent, moisture-wicking foam ring may be placed over the hair to dry the hair. When towel blotting, take care not to disrupt the hair within the case 100 and reclose the lid 110 (and if necessary, replace the foam inserts removed prior to drying). |
| Apply the neutralizer provided with the perm solution to the outside of all 4 cases 100 ensuring the neutralizer thoroughly penetrates the hair. |
| Wait allotted time for neutralizer as directed by the perm solution, typically 5 minutes. |
| Open all 4 cases 100 and remove the hair (and foam) from the base 105 of each case 100. Set cases aside. |
| Rinse the hair with water in the sink. |
| Dry and style hair to liking. |
| Rinse cases 100 thoroughly according to perm solution directions, in most embodiments, with soapy water. |

As described in Instructions Set One, to better enable drainage of the perm solution, neutralizer, and rinsing water through the case 100, the openings 130 and 160 may be spaced closer together such that there may be a greater number of openings 130 and 160 than in other embodiments to better enable drainage of the perm solution, neutralizer, and rinsing water through the case 100. In addition, additional openings may be configured on different features of the case 100 where additional drainage or airflow may be needed.

Figure 2B:
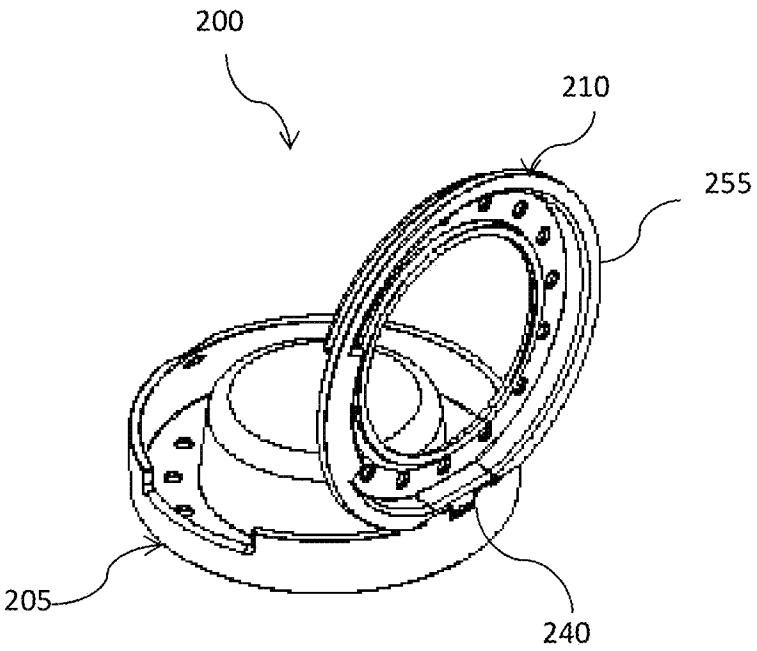
FIGS. 2A and 2B represent another embodiment of a case used for curling a person's hair according to principles of the disclosure.
Figure 2A:
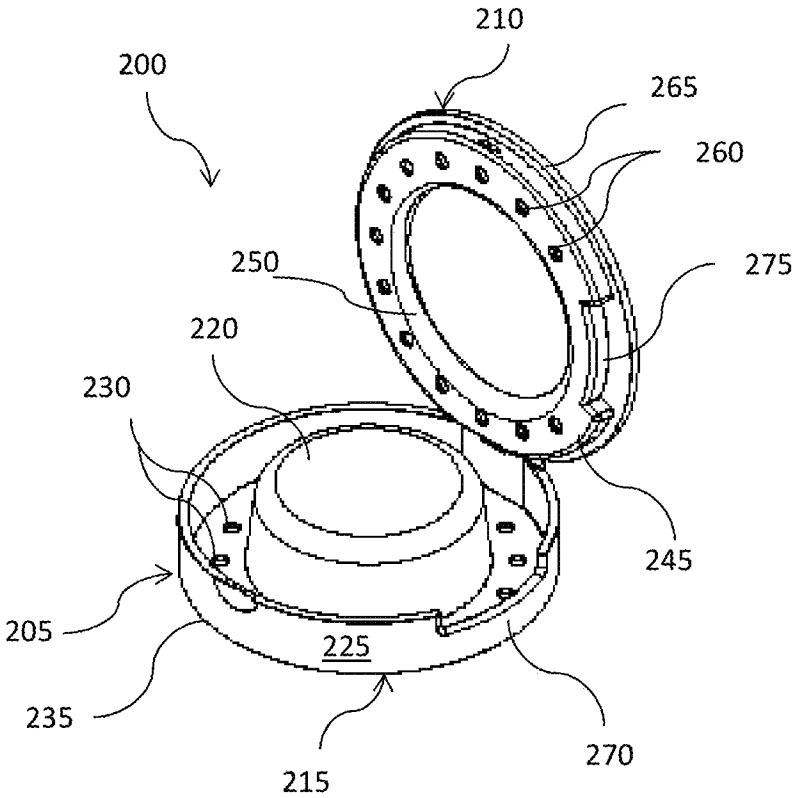

Referring now to FIGS. 2A and 2B, there is shown another embodiment of a case 200 according to the disclosure. In some uses, case 200 may be used by a consumer in a home or non-salon setting after a professional stylist has applied the curls in a process similar as described hereinabove in Instructions Set One. Case 200 may include a base 205 and lid 210 similar to case 100. The base 205 includes at least a bottom 215, a center 220, and perimeter 225. The bottom 215 includes a plurality of openings 230 at least between the center 220 and perimeter 225, the openings 230 enabling airflow through the case 200. In this embodiment, the center 220 is substantially annular in shape.

The lid 210 is coupleable with the base 205, in this embodiment, by a hinge 240, which enables the lid 210 to easily open and close over the base 205. The hinge 240 may be a closed hinge, barrel hinge, pin hinge, living hinge, or other hinges suitable for facilitating the lid to be maintained in an open position, and then facilitating closure of the lid 210 without catching or interfering with hair placed within the base 200. Other closure mechanisms may likewise be used in place of a hinge for facilitating closure of the lid 210 without catching or interfering with hair placed within the base 200.

Similar to lid 110, lid 210 may include an upper portion 245, a center 250, and a perimeter 255. The upper portion 245 may comprise a plurality of openings 260, the openings 260, together with the openings 230 of the base 205, enabling airflow through the case 200 and drainage of fluids from within the case 200.

As shown in FIGS. 2A and 2B, the openings 230 and 260 are configured as substantially round apertures in the bottom 215 and upper portion 245. The case 200 may be used by a consumer according to Instructions Set Two below, and as such, the openings 230 and 260 enable airflow through the case, but drainage is not needed when used by a consumer in a non-salon setting as no liquid or solution is applied.

| INSTRUCTIONS SET TWO<br>EXAMPLE OF PROCESS FOR A CONSUMER USER |
|---|
| After washing hair, towel dry hair as needed to remove excess water but leave the hair damp. If towel drying, a bamboo towel or paper towel is recommended, as needed, to absorb moisture. |
| If time allows, air drying is recommended until hair is damp, this may be accomplished faster by putting hair up with a hair clip to allow air to underside of hair. |
| Open all 4 cases 200 and set to the side |
| With the hair damp, divide hair into four equal quadrants using two parts, ear to ear and front to back. |
| If a stylist parted hair different during salon portion of service, match the part section to where stylist parted hair. (Ex. If stylist parted hair toward the right you may consider moving the part for the four quadrants to match the stylist's part from the professional "Cali-Curl" service.) |
| Starting left or right front quadrant put the hair into a tight ponytail shape up against the scalp. |
| Twist hair from the base of the scalp to end of the hair in the direction away from the face creating a "Roping" effect. |
| Lift an open case 200 up to the base of the scalp where the roped hair begins. Align the indenture 270 of the base 205 of the case 200 with the base of the roped hair. |
| Allow the hair to naturally coil around the center 220 of the base 205 of case 200. |
| Once end of the roped hair is reached, lay the hair evenly and smoothly in the case 200 and close the lid 210 ensuring that the hair is not caught in the hinge 240 or coming out of the case 200 anywhere. |
| Repeat these steps with the rear quadrant on the same side roping in the same direction. |
| Move to the other side and repeat these steps for the front quadrant and rear quadrant, this time roping in the opposite direction (still away from the face). |
| At this time hair may be dried using a blow dryer or allowing the hair to air dry within the cases 200. |

-continued

| INSTRUCTIONS SET TWO<br>EXAMPLE OF PROCESS FOR A CONSUMER USER |
|---|
| If blow drying, a blow-drying system having adapters such as shown in FIG. 5, 6, 9, 10, 11 and 12 may be used and require the following additional steps after the cases 200 are placed in the hair. |
| Apply the blow-drying adapter (such as adapter 502 and 602 as shown in FIG. 5, 6) to the end of a blow dryer and attach hoses and fittings for the cases with the adapter. Alternatively, you may utilize a blow dryer stand such as blow dryer stand 970 and 1070 shown in FIG. 9 and 10 in place of the blow dryer adapter. Attach hoses and fitting FIG. 11 and 12 for the cases. |
| Set blow dryer on a counter or nearby surface. |
| Pulling each hose, attach each of the four fittings or couplings as shown in FIG. 11 and 12 from the blow dryer adapter to each of the four cases. |
| Press attachment onto container until fit. |
| Once all cases 200 are firmly attached to each fitting of the blow dryer adapter, turn blow dryer on until hair is sufficiently dry. |
| Time may vary depending on dryer being used. |
| Turn blow dryer off, remove the adapter from the cases after sufficiently dried. |
| Let hair cool before moving on to next step. |
| Once hair is sufficiently dried (and cooled if using blow dryer adapter), open each case 200 and remove the hair and set aside cases 200. |
| Bend over at the waist allowing hair to fall forward. |
| Shake hair out lightly by running fingers through it a couple of times. |
| Stand back up, shake hair out and further style as needed. |

Figure 3A:
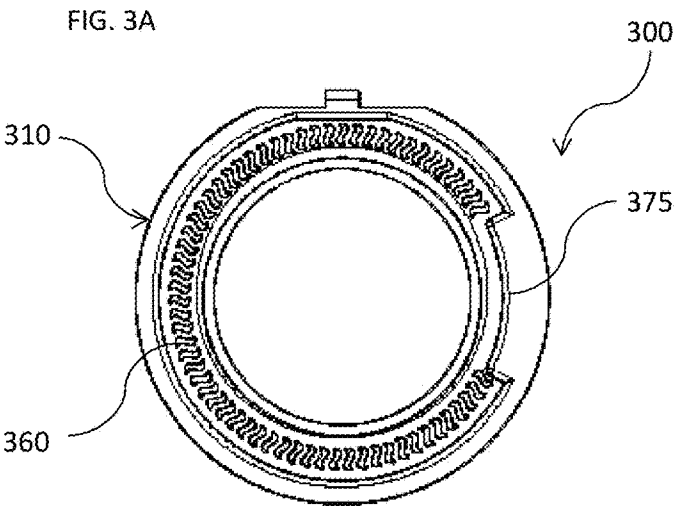
FIGS. 3A and 3B represent another embodiment of a case used for curling a person's hair according to principles of the disclosure.
Figure 3B:
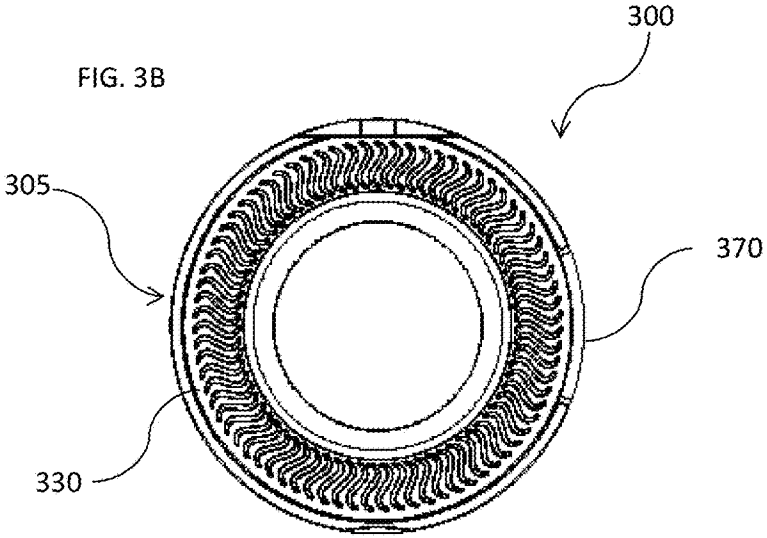

Referring now to FIGS. 3A and 3B, there is shown another embodiment of a case 300 constructed similarly to case 100. Case 300 comprises a base 305 and lid 310 that couples with the base 305 and couples thereto. The base 305 includes openings 330 in a bottom, the openings spaced at substantially equal intervals and having an "S" or curved shape. Likewise, the lid 310 has openings 360 having similar spacing and shape as openings 330.

Referring now to FIGS. 4A and 4B, there is shown another embodiment of a case 400 constructed similarly as case 100. Case 400 comprises a base 405 and lid 410 that couples with the base 405 and closes thereover. The base 405 includes openings 430 in a bottom, the openings spaced at substantially equal intervals and having a slotted or straight shape. Likewise, the lid 410 has openings 460 having similar spacing and shape as openings 430.

As illustrated by the embodiments of FIG. 1A through 4B, the openings in the base and lid of the cases may have various shapes and spacing according to the intended use of each case embodiment. As shown in FIG. 1A through 1C, the openings 130 and 160 of case 100 are more numerous and are larger in shape and size than the openings 230 and 260 of case 200. Case 100 is likely to be used in a professional salon setting where liquids and solutions are applied and drainage from the case 100 is needed, whereas case 200 may likely be used in non-salon applications where the openings 230 and 260 facilitate only airflow through the case and no drainage is needed. Additionally, the perimeter and center of the base may likewise include openings in some embodiments.

In all of the embodiments of case 100 shown, exposed edges and surfaces may be beveled or angled to provide a smoother transition surface for the hair placed within the case 100 and may also prevent hair from being creased or folded therein, lessening kinks and folds from developing in the hair.

Referring now to FIG. 5, there is shown one embodiment of a hair dryer adapter 502 which may be used with any of cases 100-400. Adapter 502 has a proximal end 504 which is configured to attach onto a distal end of a hair dryer similar to how traditional blow dryer attachments such as diffusers and concentrators attach. The adapter 502 is most likely to be used with case 200 by a consumer in a non-salon setting. Adapter 502 has a distal end 504 having a plurality of nozzles 508 extending therefrom. Once curl has been applied to a consumer's hair in a professional salon setting, heat may be used to re-activate or re-set curl to hair wrapped in case 200. Alternatively, a consumer may desire to apply a temporary "beach curl" look, without having a "permanent" style curl previously applied (similar to setting curls in hair using a curling iron or hot rollers). To apply heat to the hair roped and twisted into the cases 200, the consumer applies hoses on one end to each nozzle 508 and at another end, attached to each case 200. A coupler, such as shown in FIGS. 11 and 12 may be used to attach a hose with case 200. The hoses may be configured to fit directly onto the cases 200, or a case adapter, coupler, or fitting may be used to connect the hoses with each case 200. In some embodiments, the adapter or fitting may snap, twist, tension fit, or magnetically coupled with the cases. Once attached to the blow dryer and the cases 200, the consumer then turns on the blow dryer to apply heat to the hair within the cases 200 until the hair is substantially dry, as discussed hereinabove in Instructions Set Two.

Referring now to FIG. 6, there is shown another embodiment of an adapter 602 which may be used with any of cases 100-400 to apply heat to hair placed therein. Similar to adapter 502, adapter 602 comprises a proximal end 604 and a distal end 606, the proximal end 604 configured to attach onto a blow dryer. Distal end 606 includes a plurality of nozzles 608 that may receive hoses thereon, the hoses then attached at an other end to cases, such as cases 200, either directly or by a case adapter or coupler as shown in FIGS. 11 and 12.

The adapters 502 and 602 are shown having four nozzles, for use with four cases, but embodiments of an adapter may comprise more or less nozzles 508 and 608 according to a number of cases required according to a consumer's hair length and type. Likewise, the distal ends 504 and 604 may have different configurations and arrangement of nozzles 508 and 608. In other embodiments, the adapter may attach with the cases and/or the blow dryer via magnetic connectors or couplers.

The adapters, hoses, and couplers or fittings for connecting with the cases may be constructed of heat resistant materials, or may be coated with heat resistant material or silicon coating that may be permanent or removable.

Figure 7C:
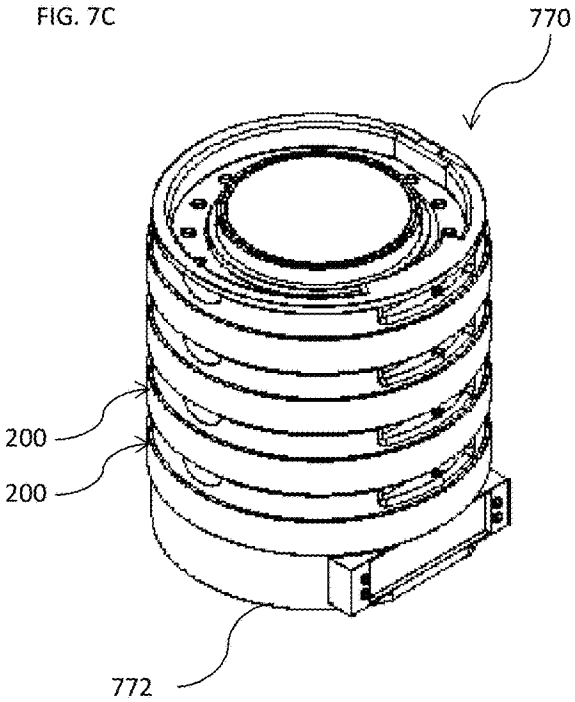
FIG. 7A through 7C illustrate an embodiment of a base that may be used to heat embodiments of a case used for curling a person's hair according to principles of the disclosure.
Figure 7B:
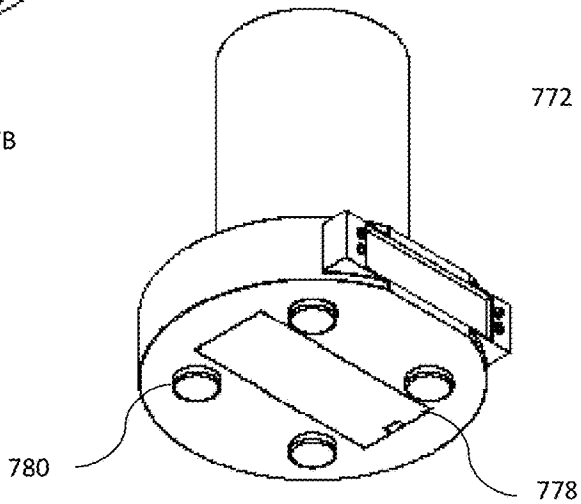
Figure 7A:
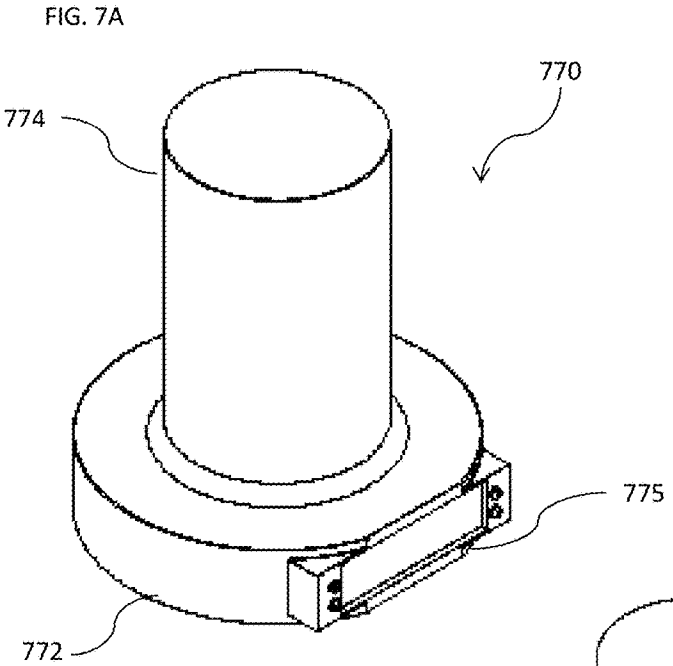

Referring now to FIG. 7A through 7C, there is shown a stand 770 that may be used with any of cases 100 through 400, in this embodiment, case 200 is shown. Stand 770 comprises a stand base 775 and center piece 780 that protrudes upward therefrom. Center piece 780 may be configured having a substantially circular shape such that cases 200 may be stacked therearound as shown in FIG. 7C. In some embodiments, the stand 770 may have a lid that may fit on tops of the upper most stacked case 200, or may be conical or cylindrical in shape such that the lid fits over all the cases 200 stacked on the stand 770.

Stand 770 may include a heating element. The heating element may be positioned in or about the base 772 or inside the center piece 774. The heating element may be similar in construction and function to heating elements such as used in hot rollers. The cases 200 may be stored on stand 770, and may also be heated. The case 200 may be constructed using heat conducting materials, but may also be configured with a removable heating element, as shown in FIG. 8A through 8D. In other embodiments, the heating element may be secured beneath the base or may also be secured beneath the lid.

The base 772 may include a user interface 776 having at least a display and one or more controls such that a user may control and monitor the operation of the stand 770, and more particularly, the heating element which may be positioned therein. The heating element may have a controlled standard heat setting or may be controlled by a digital control system. The display on the user interface may be touch controlled for changing the settings. The stand may operate on either direct electrical power, or may operate using a renewable energy source, such as batteries. The batteries may be disposable or rechargeable. The batteries may be positioned with a battery compartment 778 beneath the base 772. In some uses, the stand 770 may be placed on a vanity or a countertop and as such, may be near a surface exposed to water. As such, the base 772 may comprise feet 780 to elevate the stand 770, and also protect the surface on which the stand 770 may be placed. The feet 780 may comprise rubber or silicon, or may include suction cups.

In some embodiments, stand 770 may include a fan or circulation feature to facilitate circulation of heated air through the cases stacked thereon. In some embodiments, the fan or circulation feature may be incorporated into the conical or cylinder lid configured to cover all cases stack onto the stand 770.

Figure 8B:
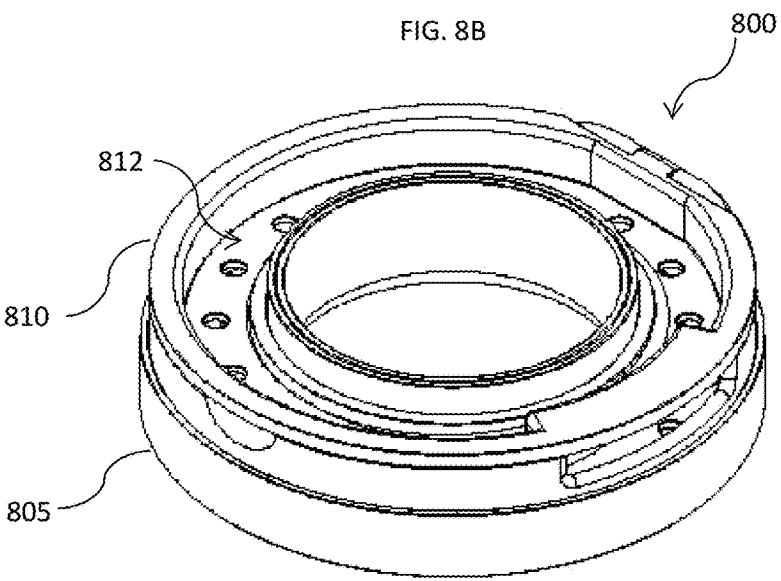
FIG. 8A through 8D represent an embodiment of a case having a heating insert according to principles of the disclosure.
Figure 8A:
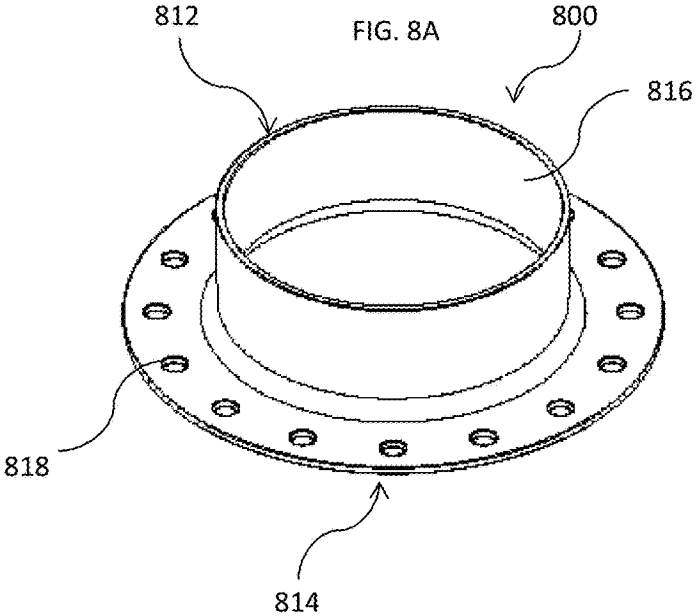
Figure 8D:
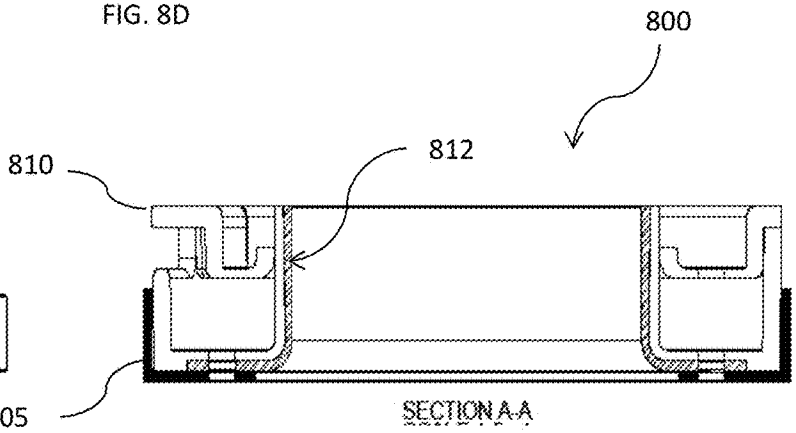
Figure 8C:
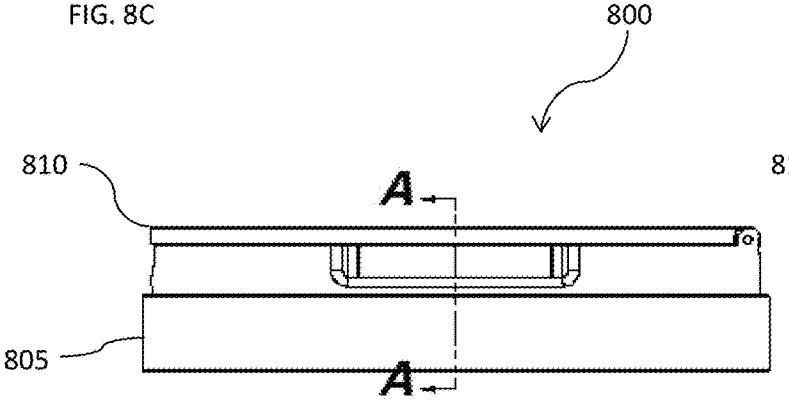

Referring now to FIG. 8A through 8D, there is shown another embodiment of a case 800 constructed according to the principles of the disclosure. Case 800 may include a removable heating element 812. Heating element 812 may comprise a base ring 814 and a center 816 protruding upward therefrom. Similar to openings in base 805 and lid 810, the heating element 812 may include openings 818 to facilitate airflow through the case 800. FIG. 8D illustrates a sectional view of FIG. 8C showing the heating element 812 positioned within the case 800. In one embodiment, the heating element 812 may be heated by placing case 800 about a stand such as stand 770, and heated by a heating source therein. The heating element inserted within the case may be made, in one embodiment, of a metal that uses induction to transfer heat from the stand to the case. An example of this type of metal could be magnetic grade stainless steel. In other embodiments, the heating element may also comprise a ceramic material, or other various heat conducting composites or polymers, and/or may be coated with a heat conducting material such as a ceramic, composite, or polymer.

Figure 9C:
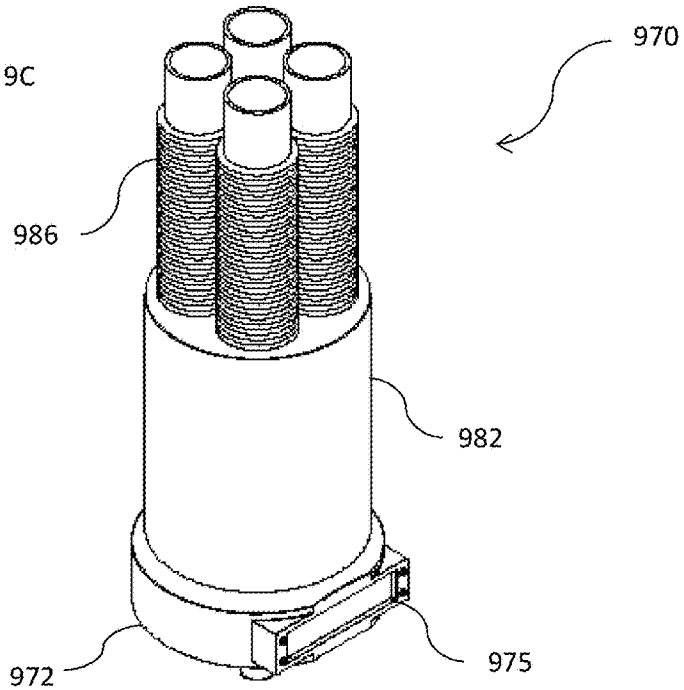
FIG. 9A through 9D illustrate an embodiment of a dryer stand that may be used with any of the cases shown in FIGS. 1-4 and 8 according to principles of the disclosure.
Figure 9D:
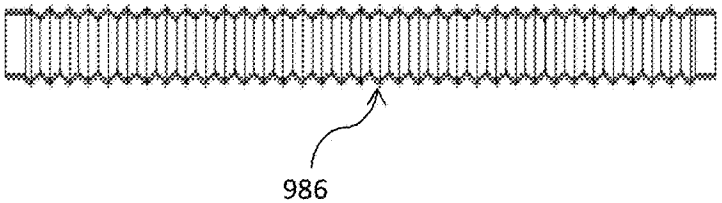
Figure 9A:
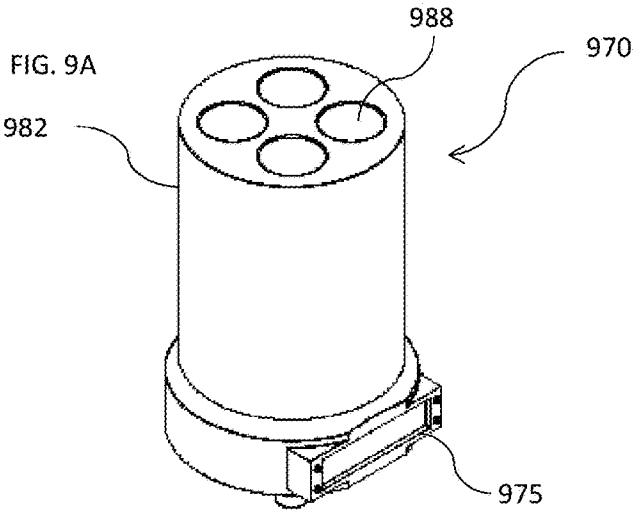
Figure 9B:
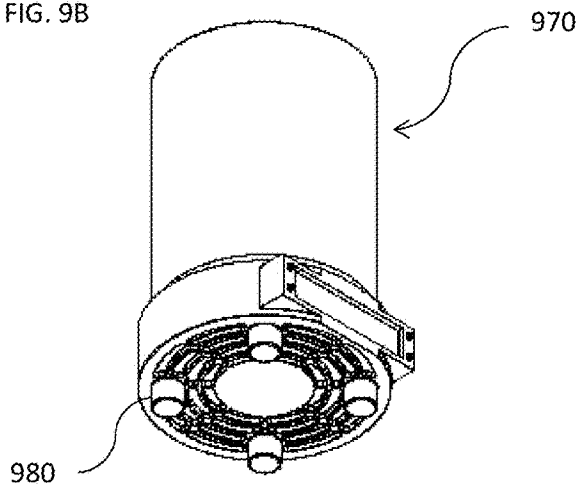

Referring now to FIG. 9A through 9C, there is shown a dryer stand 970 which may be used to dry hair placed in any of the cases 100-800 as shown herein. Dryer stand 970 includes a stand base 972 and a housing 982 above, the housing 982 enclosing all motors, heating elements, blowers, etc. such as may be found in traditional consumer hand held hair dryers. A user interface 975 may include a display and/or controls. The user interface 975 may be a digital display having touch-screen controls, or may have more traditional buttons and manual controls.

The dryer stand 970 may be placed on top of a counter and accordingly includes feet 880 on a bottom surface of the stand base 972. Feet 880 may comprise rubber or silicon to prevent the dryer stand from slipping on the counter. Also beneath the stand base 972 is an air intake 984 for drawing air into the dryer stand 970, similar to an air intake of a traditional handheld hair dryer.

A plurality of hoses 986 may be placed into annular openings 988 of the housing 982. Each hose 986 is thereafter coupled with a case (such as case 200) to deliver heated air to hair placed within the case. Couplers such as those shown in FIGS. 11 and 12 and described hereafter may be used to couple the hose with each case.

Figure 10C:
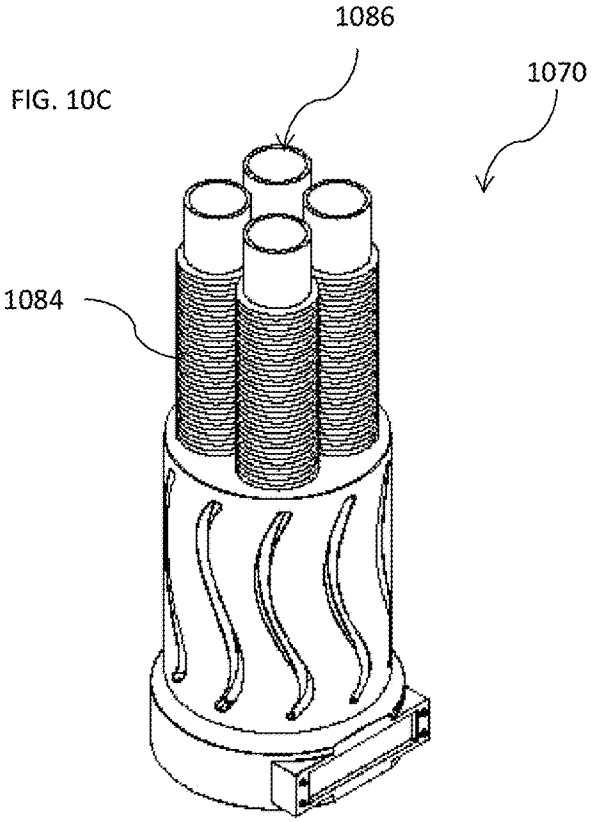
FIG. 10A through 10C illustrate another embodiment of a dryer stand that may be used with any of the cases shown in FIGS. 1-4 and 8 according to principles of the disclosure.
Figure 10A:
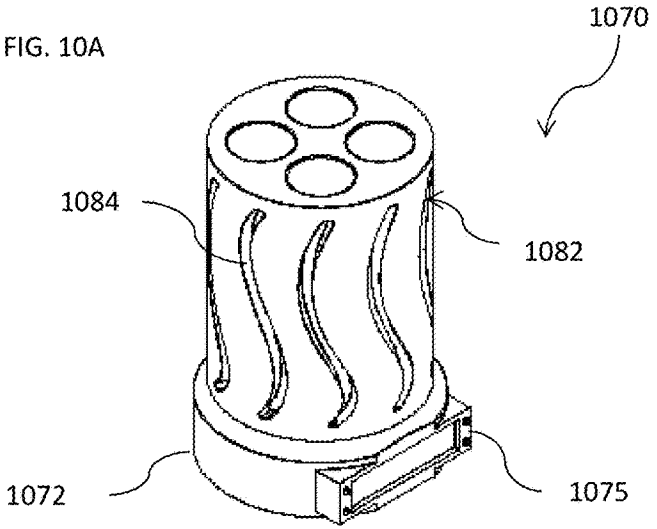
Figure 10B:
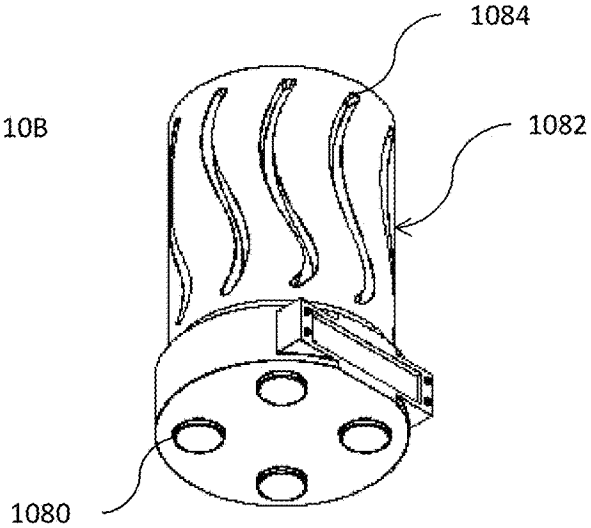

Referring now to FIG. 10A through 10C, there is shown another embodiment of a dryer stand 1070 which may be used with any of cases 100-800 as shown and described above. Dryer stand 1070 is similar to dryer stand 970 except for air intake 1084 is located about housing 1082 rather than beneath dryer base 1072. A plurality of hoses 1086 and couplers such as described herein are used to deliver heated air to hair placed in cases.

Referring now to FIG. 11A through 11E, there is shown a coupler 1101 which may be used with cases shown and described herein according to the principles of the disclosure. The coupler 1101 may be used to connect a hair dryer, such as a traditional handheld dryer or a dryer stand, such as dryer stand 970 or 1070 with a case 1100 to provide heated air to the hair placed within the case. The coupler 1101 may comprise a hollow conical shape having a capped distal end 1103 that may slide into a base 1105 of a case 1100. The case 1100 may be constructed similar to case 100 or 200 and comprise at least the base 1105 and a lid 1110. The base 1105 has an annular center 1120 into which the coupler 1101 may be inserted.

Figures 11A, 11B, 11C, 11D, 11E:
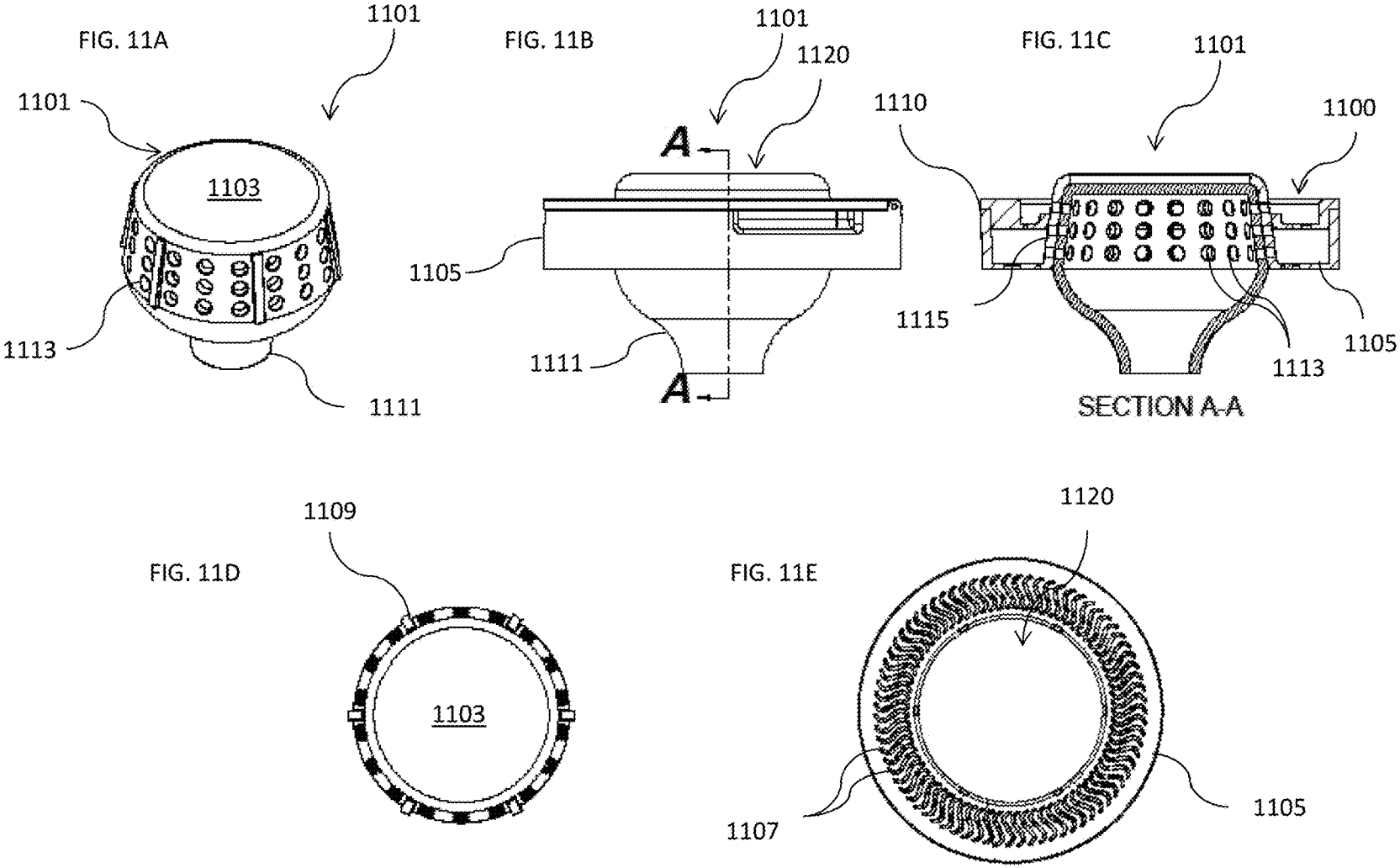

The annular center 1120 of the base 1105 may include slots 1107 for receiving keys 1109 about the perimeter of the coupler 1101. A hose, such as hose 986 attaches to a proximal end 1111, the hose delivering hot air from a hair dryer, such as a traditional hair dryer or dryer stand 970. As shown in FIGS. 11A and 11C, the coupler 1101 has openings 1113 about its perimeter to enable air to flow through the openings 1113 and into the case 1100. Case 1100 may have similar openings 1115 which openings 1113 can match with for better delivery of air into the case 1100.

Coupler 1101 may be constructed using a plastic, polymer, or metal material, or any combination thereof, such that coupler 1101 may withstand repeated exposure to heat from the dryer stand and passing onto the case 1100.

Referring now to FIG. 12A through 12E there is shown another embodiment of a coupler 1201 which may be used with cases according to the principles of the disclosure. Case 1200 may be constructed similar to any of cases 100-800 or case 1100 and comprise at last a base 1205 and a lid 1210. The coupler 1201 may comprise a cup 1202 having a conical distal cap 1203 protruding therefrom. The cup 1202 may have a diameter slightly larger than that of case 1200 such that the cup 1202 fits over and around base 1205 of case 1200. The distal cap 1203 may be inserted into annular center 1220, the annular center having slots 1207 for receiving keys 1209 about the perimeter of the coupler 1201. A hose, such as hose 986 attaches to a proximal end 1211, the hose delivering hot air from a hair dryer, such as a traditional hair dryer or dryer stand 970.

Figure 12B:
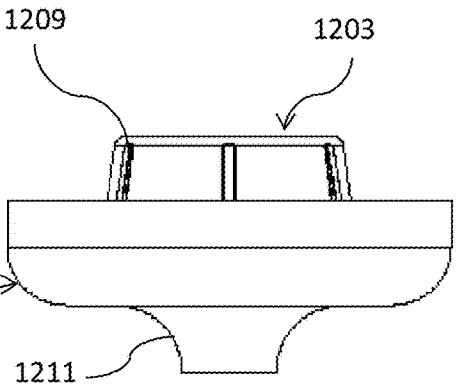
Figure 12A:
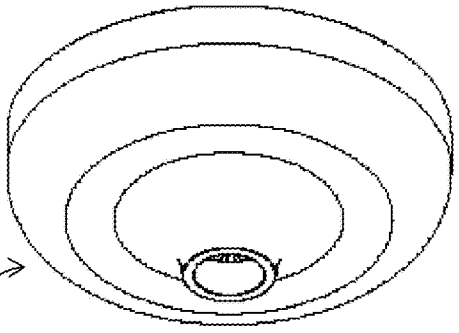
Figure 12E:
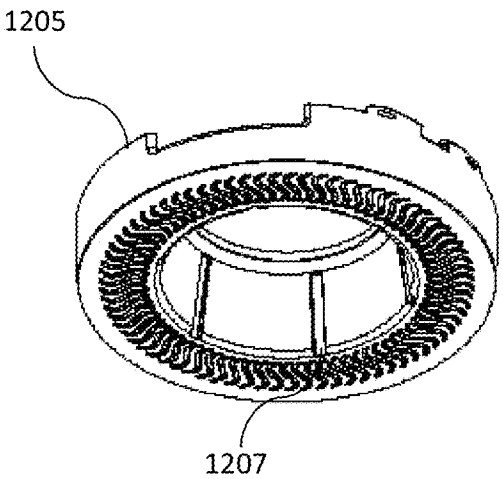
Figure 12D:
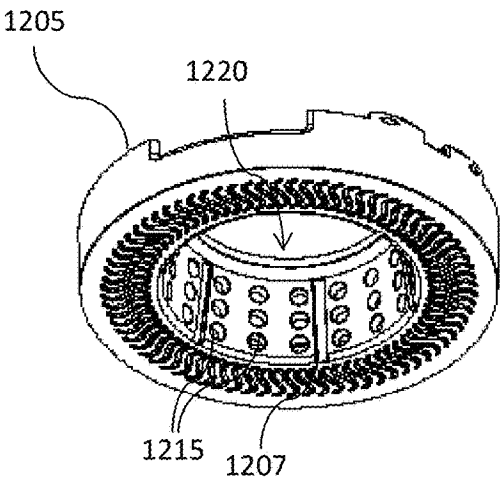
Figure 12C:
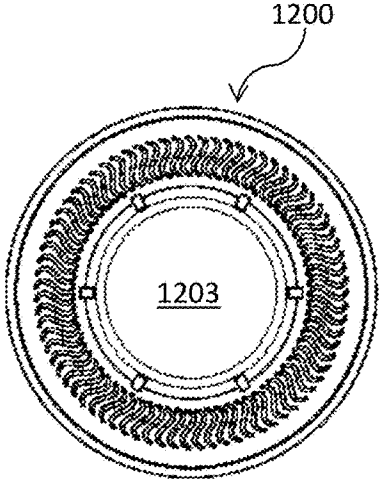

As shown in FIGS. 12B and 12E, the distal cap 1203 may not have any openings, such that the airflow from the hair dryer is delivered from the cup 1202 around the base 1205. In another embodiment, as shown in FIG. 12D, the coupler 1201 may have openings about the perimeter of distal cap 1203 to enable air to flow through the openings and into openings 1215 of the annular center 1220 of case 1200.

The cases 100-1200 as shown and described herein may be constructed using various materials. In some embodiments, the cases may be constructed using a heat durable polymer or durable plastic material. In some embodiments, the cases may be constructed using metals and have a silicone or rubber coating thereon. The silicone or rubber coating may partially or fully cover the base and lid of each case, and in some embodiments, may be removable. Still other embodiments may be constructed using other heat resistant materials known to those skilled in the art of designing and manufacturing hair styling products.

Likewise, the cases 100-800 may be constructed in various diameter sizes, with various dimensions of each sized scaled and sized accordingly. A client having longer and/or thicker hair may need larger cases, while a client with shorter and/or finer hair may need a smaller case. Further, as discussed in conjunction with FIG. 1, porous foam ring inserts, or portions thereof may be used to help maintain the hair in place once wrapped inside the case.

The heating elements discussed in FIG. 7-10 may be constructed using inductive heat technology, or other heat technologies that may not need an external heating source, and in some embodiments, are cool to the touch to prevent burns to skin or hair coming in contact therewith. The heating element on the stand may have a ceramic coating applied to it.

the wellbore, and may be retrieved by conventional methods.

Various aspects of the disclosure can be claimed including the apparatuses, systems, and methods disclosed herein. Aspects disclosed herein include:

A: A case for receiving and styling hair therein, comprising a base having at least a bottom, a center, and a perimeter; and a lid coupleable with the base; wherein the lid and the base form a volume for receiving the hair; and wherein the at least the bottom of the base and the lid each include a plurality of openings to allow flow of air and liquids through the case.

B: A hair styling system, comprising at least one case for receiving the hair therein, the at least one case comprising: a base having at least a bottom, a center, and a perimeter; and a lid coupleable with the base; wherein the lid and the base form a volume for receiving the hair; and wherein the at least the bottom of the base and the lid each include a plurality of openings to allow flow of air and liquids through the case; and a styling solution for use on the hair received into the case.

C: A method of styling hair, the method comprising: providing one or more cases for receiving the hair therein, the case comprising a base having at least a bottom, a center, and a perimeter; and a lid coupleable with the base; wherein the lid and the base form a volume for receiving the hair; and wherein the at least the bottom of the base and the lid each include a plurality of openings to allow flow of air and liquids through the case; and providing a styling solution for use on the hair received into the case.

Each of aspects A, B, and C can have one or more of the following additional elements in combination:

Element 1: wherein the lid is coupled with the base by a hinge;

Element 2: wherein the perimeter of the base includes a lateral slot in a portion of a top edge of the perimeter, the lateral slot providing an opening between the base and the lid for receiving hair extending from within the case;

Element 3: wherein the lateral slot has beveled edges;

Element 4: wherein the lid includes a lateral slot, wherein the lateral slot of the lid is positioned over the lateral slot of the base when the lid is closed over the base;

Element 5: wherein the center of the base is open;

Element 6: wherein the lid has an opening in a center thereof, and wherein the center of the base protrudes through the opening in the center of the lid;

Element 7: wherein the center of the base has beveled edges; and

Element 8: wherein the styling solution is a chemical permanent solution.

Those skilled in the art to which this application relates will appreciate that other and further additions, deletions, substitutions and modifications may be made to the described embodiments.

The invention claimed is:

1. A case for receiving and styling hair therein, comprising:

a base having at least a bottom, a center, and an outer annular wall; and a lid coupleable with the base, the lid comprising an indented upper portion and an annular perimeter around the indented upper portion, wherein when the lid is closed over the base, a bottom surface of the annular perimeter contacts a top edge of the outer annular wall and the annular perimeter is raised above the indented upper portion;

wherein the lid and the base form a volume for receiving the hair; and wherein at least the bottom of the base and the indented upper portion of the lid each include a plurality of openings to allow flow of air and liquids through the case.

2. The case according to claim 1, wherein the lid is coupled with the base by a hinge.

3. The case according to claim 1, wherein the outer annular wall of the base includes a lateral slot in a portion of the top edge that provides an opening between the base and the lid for receiving hair extending from within the case when the lid is closed over the base.

4. The case according to claim 3, wherein the lateral slot has beveled edges.

5. The case according to claim 3, wherein the lid includes a lateral slot, wherein the lateral slot of the lid is positioned over the lateral slot of the outer annular wall when the lid is closed over the base.

6. The case according to claim 1 wherein the center of the base is open.

7. The case according to claim 6, wherein the indented upper portion of the lid has an opening in a center thereof, and wherein the center of the base protrudes through the opening in the center of the indented upper portion of the lid when the lid is closed over the base.

8. The case according to claim 1, wherein the center of the base has beveled edges.

9. A hair styling system, comprising:

at least one case for receiving the hair therein, the at least one case comprising:

a base having at least a bottom, a center, and a perimeter, wherein the perimeter comprises an outer annular wall; and a lid coupleable with the base, the lid comprising an indented upper portion and an annular perimeter around the indented upper portion, wherein the annular perimeter is raised above the indented upper portion such that when the lid is closed over the base, a bottom surface of the annular perimeter contacts a top edge of the outer annular wall of the base;

wherein the lid and the base form a volume for receiving the hair; and wherein at least the bottom of the base and the indented upper portion of the lid each include a plurality of openings to allow flow of air and liquids through the case; and a styling solution for use on the hair received into the case.

10. The system according to claim 9, wherein the styling solution is a chemical permanent solution.

11. The system according to claim 9, wherein the lid is coupled with the base by a hinge.

12. The system according to claim 9, wherein the outer annular wall of the perimeter of the base includes a lateral slot in a portion of the top edge of the outer annular wall, the lateral slot providing an opening between the base and the lid for receiving hair extending from within the case.

13. The system according to claim 12, wherein the lateral slot has beveled edges.

14. The system according to claim 9, wherein the center of the base has beveled edges.

15. A method of styling hair, the method comprising:

employing at least one case for receiving the hair therein, the case comprising:

a base having at least a bottom, a center, and a perimeter, wherein the perimeter comprises an outer annular wall; and a lid coupleable with the base, the lid comprising an indented upper portion and an annular perimeter around the indented upper portion, wherein the annular perimeter is raised above the indented upper portion such that when the lid is closed over the base, a bottom surface of the annular perimeter contacts a top edge of the outer annular wall of the base;

wherein the lid and the base form a volume for receiving the hair; and wherein the at least the bottom of the base and the indented upper portion of the lid each include a plurality of openings to allow flow of air and liquids through the case; twisting hair and placing the twisted hair into the at least one case; and applying a styling solution for use on the hair received into the at least one case.

16. The method according to claim 15, wherein the styling solution is a liquid chemical permanent solution.

17. The method according to claim 15, wherein the lid is coupled with the base by a hinge.

18. The method according to claim 15, wherein the outer annular wall of the perimeter of the base includes a lateral slot in a portion of the top edge of the outer annular wall, the lateral slot providing an opening between the base and the lid for receiving hair extending from within the case.

19. The method according to claim 18, wherein the lateral slot has beveled edges.

20. The method according to claim 18, wherein the annular perimeter of the lid includes a lateral slot, wherein the lateral slot of the lid is positioned over the lateral slot of the outer annular wall when the lid is closed over the base.

* * * * *